United States Patent [19]

Tanne et al.

[11] Patent Number: 4,738,038

[45] Date of Patent: Apr. 19, 1988

[54] ADVERTISING DISPLAY CARD APPARATUS

[75] Inventors: Scott Tanne, Livingston; Ronald M. Kaplan, Verona, both of N.J.; George Wright, Sr., Brooklyn, N.Y.

[73] Assignee: Mini-Billboard Corp., Parsippany, N.J.

[21] Appl. No.: 5,621

[22] Filed: Jan. 21, 1987

[51] Int. Cl.[4] ..... G09F 3/18

[52] U.S. Cl. ..... 40/10 D; 40/493; 211/78; 211/131

[58] Field of Search ..... 40/10 R, 10 D, 19, 493, 40/606; 211/53, 56, 58, 70, 77, 78, 131

[56] References Cited

U.S. PATENT DOCUMENTS

| | | | |
|---|---|---|---|
| 429,893 | 6/1890 | Dahlstrom | 40/47 Z |
| 632,649 | 9/1899 | Goldberg | 40/493 |
| 3,711,975 | 1/1973 | Downing | 40/10 R |
| 4,432,151 | 2/1984 | Morris | 40/493 |
| 4,505,059 | 3/1985 | Morris | 40/10 D |

FOREIGN PATENT DOCUMENTS

| | | | |
|---|---|---|---|
| 430540 | 10/1911 | France | 40/493 |
| 496280 | 2/1937 | United Kingdom | 40/493 |

*Primary Examiner*—Robert P. Swiatek
*Assistant Examiner*—Cary E. Stone
*Attorney, Agent, or Firm*—Thomas W. Tolpin

[57] ABSTRACT

A lightweight compact, portable, advertising display apparatus provides an attractive, rotatable, miniature billboard assembly for displaying advertising material to viewing areas about the advertising display apparatus. The advertising display apparatus includes a plastic shaft with a convenient handle and a special coupling head which fits into corresponding keyholes in the container assembly to provide for easy assembly and disassembly of the unit when inserting and removing different advertising material.

19 Claims, 2 Drawing Sheets

ADVERTISING DISPLAY CARD APPARATUS

BACKGROUND OF THE INVENTION

This invention relates to signs and, more particularly to a compact portable advertising display apparatus for use on restaurant tables and the like.

Advertising is an often untapped source of supplemental revenue and goodwill in restaurants or other stores where customers wait at tables for their food or wait in line, such as at a cashier, to pay for their meals or wait for other services or products. Such customers are a captive audience for many types of advertising media while they wait, eat, and sit at the tables or wait in line.

Over the years various items have been used in restaurants for the information and entertainment of customers, such as paperboard signs promoting the feature entrees or drinks of the day for the restaurant and placements mats containing various promotional information, puzzles, or games. In recent years, portable advertising displays have been placed on restaurant tables and the like, as a miniature billboard, to display various advertisements and business cards. Typifying these displays, signs, and other devices are those shown in U.S. Pat. Nos. 165,147; 2,000,419; 2,079,303; 3,364,600; 2,123,257; 2,610,421; 3,105,315; 3,561,146; 3,3,629,967; 4,125,954; 4,432,151; 4,505,059; Des. 156,670; Des. 157,446; Des. 170,650; Des. 195,270; and Des. 276,628. These prior art displays, signs, and other devices have met with varying degrees of success.

While many of the prior portable advertising displays and miniature billboards are quite useful, some of them are difficult and tedious to assemble and awkward and cumbersome to install and remove advertisements and business cards. Such difficulty can frustrate and discourage restaurant owners, patrons, and others from using such advertising displays and miniature billboards.

It is, therefore, desirable to provide an improved advertising display apparatus which overcomes most, if not all, of the preceding difficulties.

SUMMARY OF THE INVENTION

An improved compact, portable advertising display apparatus provides a miniature billboard assembly which is attractive, easy to use, and simple to install and remove advertisements, business cards, and the like. Desirably, the novel compact advertising display apparatus is effective, efficient, convenient, and economical to manufacture and use.

To this end, the novel advertising display apparatus provides a display case or container which comprises a receptacle for holding, storing, and supporting comestible material or other items such as packets of salt, pepper, sugar, and/or toothpicks. The receptacle has transparent plastic walls or other window means for displaying advertisements, business cards, promotional and informational material, and the like from various viewing areas.

In order to remove the container from its support base to insert, remove, or interchange advertisements, business cards, etc., the container has a central opening comprising a shaft-receiving opening and a coupling-receiving opening which extends transversely, radially, or diametrically outwardly of the shaft-receiving opening and a rotatable upright shaft of impact-resistant plastic extends upwardly through the base. The shaft has a head comprising a coupling at its upper end, above the top of the base and a handle at its bottom end positioned in a central hole in the base below the top surface of the base. The shaft is angularly moveable and rotatable from an access, installation, and removal position to slidably engage the coupling-receiving opening of the container when accessing, installing, or disassembling the container to install, insert, and/or remove advertisements or business cards and the like, to a locking position upwardly of and transverse to the coupling-receiving slot to interlockingly engage and securely mount the container to the shaft upon the base.

In the preferred form, the handle comprises a manually grippable, planar or flat blade which extends transversely outwardly of the shaft. The coupling can comprise at least one radial lug or transverse plastic pin. Preferably, the head comprises a T-shaped coupling.

In the preferred form, the plastic shaft extends upwardly through a pedestal or hub on a plastic container-supporting platform and the support platform is rotatably mounted upon the base by a bearing.

A more detailed explanation of the invention is provided in the following description and appended claims taken in conjunction with the accompanying drawings.

DETAILED DESCRIPTION OF THE PREFERRED EMBODIMENTS

A lightweight compact, portable, advertising display card apparatus 10 (FIGS. 1–3) provides a rotatable miniature billboard assembly for displaying advertising material to viewing areas spanning 360 degrees about the advertising display apparatus 10. The advertising display apparatus 10 is particularly useful when placed on tables and counters in restaurants and stores. The advertising display apparatus 10 is aesthetically pleasing, attractive, and easy to use. The advertising display apparatus 10 is also effective, efficient, convenient, and economical to manufacture and use.

The advertising material can take the form of business cards or paper or paperboard sheets with advertising, publicity, promotional, or informational material with printed indicia thereon. Advertising material is simple to install, interchange, and replace in the advertising display apparatus 10.

Figure 2:
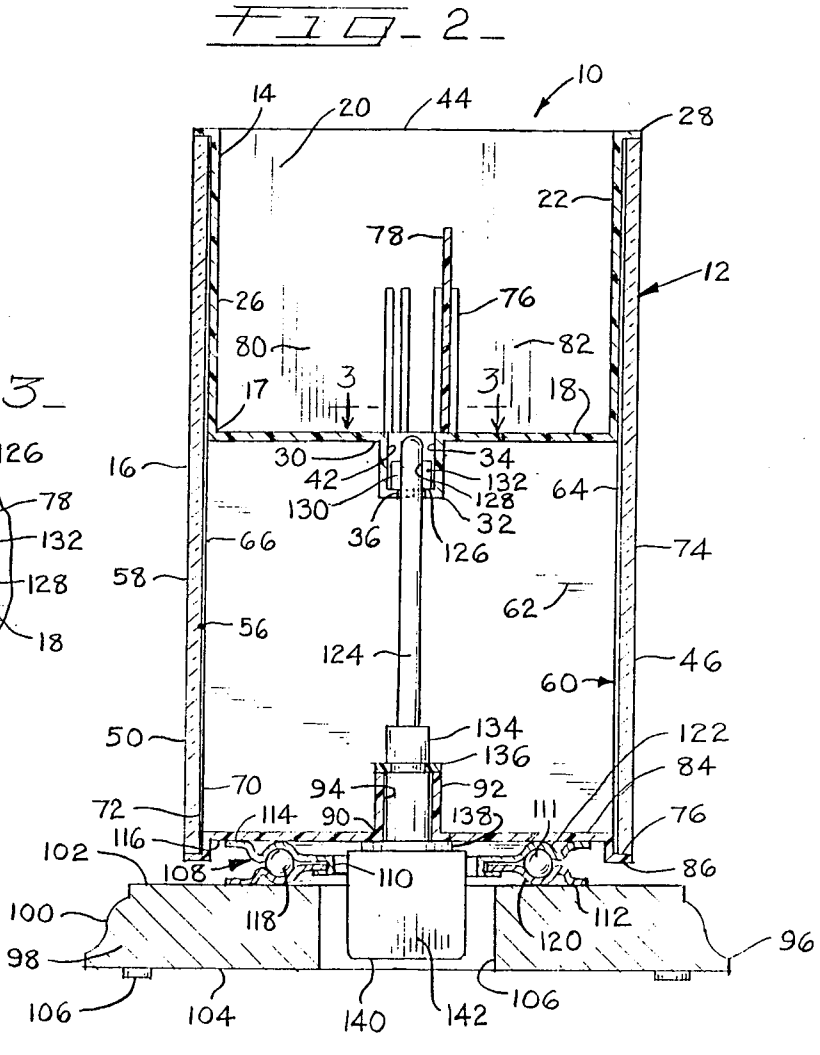
FIG. 2 is a cross-sectional side view of the advertising display apparatus taken substantially along lines 2—2 of FIG. 1.
Figure 3:
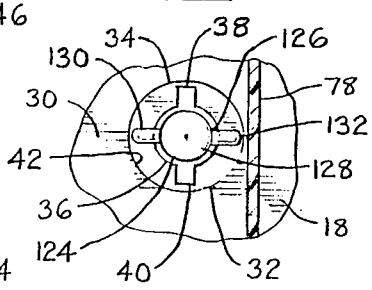
FIG. 3 is a fragmentary cross-sectional view of the coupling head of the shaft of the advertising display apparatus taken substantially along lines 3—3 of FIG. 2.
Figure 1:
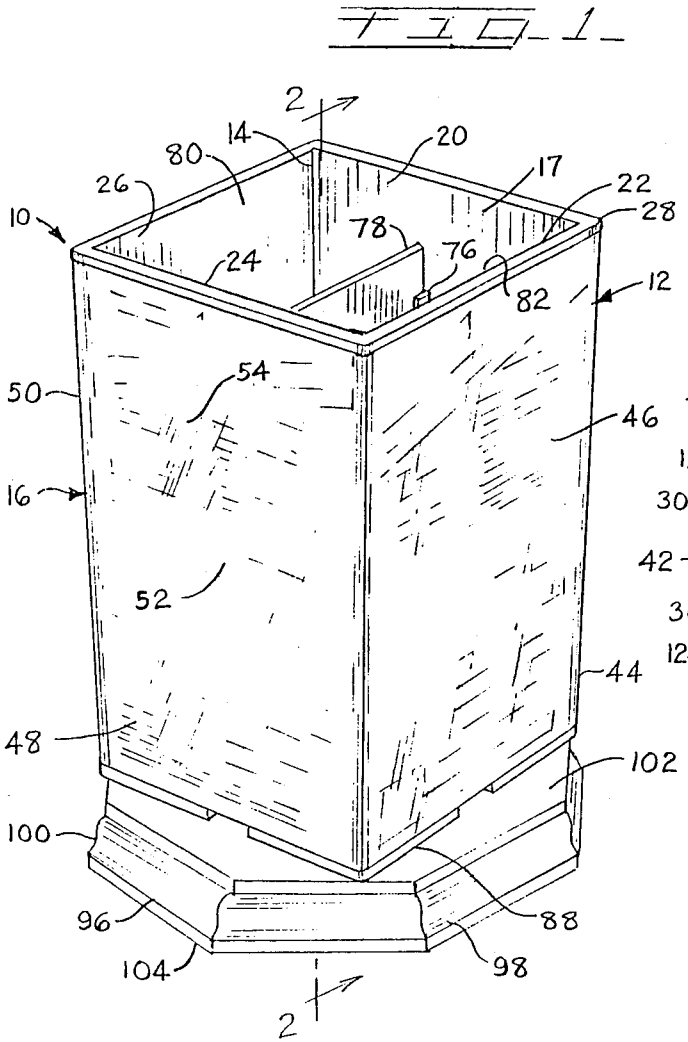
FIG. 1 is a perspective view of an advertising display apparatus in accordance with principles of the present invention.

As shown in FIGS. 1–3, the advertising display apparatus and miniature billboard 10 comprises a display case and container assembly 12. The container assembly 12 includes a white translucent plastic core 14 and a clear transparent plastic outer shell 16. The core 14 comprises an open top (ended) bin and receptacle 17 for holding items such as packets of salt, pepper, sugar and toothpicks. The receptacle 17 is substantially rigid and solid. The receptacle 17 has a horizontal floor 18 and vertical rectangular walls 20, 22, 24, and 26 which extend upwardly from the floor 18. The receptacle 17 has an upper rectangular peripheral flange and lip 28 which is connected to and extends outwardly of an upper top portion of the vertical walls.

As shown in FIGS. 2 and 3, the floor 18 of the receptacle 17 has a central portion 30 with a downwardly extending annular hub or foot 32 with a vertical central opening 34 positioned about the vertical axis of the advertising display apparatus 10. The central opening 34 includes a shaft-receiving opening 36, diametrically opposite coupling-receiving radial slots 38 and 40 which provide keyways that extend transversely outwardly of the shaft-receiving opening 36, and a lug-receiving or coupling-receiving recessed opening 42 having a greater diameter than and positioned above the shaft-receiving opening 36.

The outer shell 16 (FIGS. 1 and 2) of the container assembly 12 comprises a rectangular rigid tube with rectangular transparent wall portions 44, 46, 48, and 50 which provide windows 52 for viewing the advertising material 54. The wall portions of the outer shell 16 have an inner surface 56 and an outer exterior surface 58.

A flexible plastic, opaque black inner shell 60 (FIG. 2) is positioned adjacent the inner surface 56 of the outer shell 16. Prior to assembly, the inner shell 60 can be collapsed to a flat storage position. The inner shell 60, when installed, has a rectangular tubular cross section with rectangular wall sections 62, 64, and 66. The wall sections of the inner shell comprise support members with an outer surface 70 and an inner surface 72. The outer surface 70 of the inner shell substantially covers the inner surface 56 of the outer shell 16. The advertising material is sandwiched and positioned between the outer surface 70 of the inner shell 60 and the inner surface 72 of the outer shell 16.

The inner and outer shells 60 and 16 abut against and engage the upper overhanging flange 28 of the receptacle 17 and are positioned adjacent the wall of the receptacle 17. The shells 60 and 16 extend downwardly from the upper flange 28 of the receptacle 17 to a position substantially below the floor 18 of the receptacle to provide a downwardly extending composite skirt 74. The skirt has a rectangular bottom peripheral edge 76.

In the embodiment of FIGS. 1 and 2, the opposite end walls 20 and 24 of the receptacle 17 has pairs of outwardly extending, partition-gripping ribs 76. An upright planar or flat rectangular, plastic partition 78 snap fits in interlocking engagement with said ribs to divide the receptacle into two separate chambers or compartments 80 and 82 to separate different items, such as packets of salt and pepper.

As shown in FIG. 2, the advertising display apparatus 10 has a white opaque, rectangular plastic platform 84 with a peripheral flange portion 86 which abuttingly engages the bottom edge 76 of the composite skirt 74 and supports the container assembly 12. The flange portions 86 extend integrally below and outwardly of the platform 84 and can comprise perpendicular L-shaped corner sections 88 (FIG. 1). The central section or middle portion 90 of the platform has an upwardly extending, annular pedestal 92 or hub with a vertical, central shaft-receiving hole 94 positioned about the vertical axis of the advertising display apparatus 10. The central shaft-receiving hole 94 is in coaxial vertical alignment and registration with the central opening 34 of the receptacle 17.

The advertising display apparatus 10 has a wooden base 96 (FIGS. 1 and 2), such as an octagonal base 98 with routed convex profiled sides 100. The base has a flat or planar upper surface 102 and a flat or planar lower surface 104 with resilient felt legs 106 for positioning the display apparatus 10 upon a table or counter in a restaurant or store. The base has a vertical central handle-receiving opening or hole 106 positioned about the vertical axis of the advertising display apparatus 10. The handle-receiving hole 106 is in coaxial alignment and registration with the platform hole 94 and the receptacle hole 34.

As shown in FIG. 2, the advertising display apparatus 10 has a swivel assembly 108 which permits the container assembly 12 and platform 84 to rotate upon the base 96. The swivel assembly 108 has a central shaft-receiving hole 110 about the vertical axis of the advertising display apparatus 10. The shaft-receiving hole 110 is in coaxial alignment and registration with the hole 106 in the base 96, the hole 94 in the platform 84, and the hole 34 in the receptacle 17. The swivel assembly 108 comprises an annular ball bearing assembly 111 with a lower metal plate 112 secured by rivets or other fasteners to the upper surface 102 of the base 96, an upper metal plate 114 secured by rivets or other fasteners to the underside 116 of the platform 84, and a circular array of ball bearings 118 positioned in concave ball-retaining channels 120 and 122 of the lower and upper plates.

In order to easily secure and detach the container assembly 12 to the platform 84, an upright semi-rigid shaft 124 (FIGS. 2 and 3) of impact-resistant plastic is provided. The plastic shaft 124 fits into and slidably engages the shaft-receiving opening 36 of the receptacle 17. The plastic shaft 124 has an upper T-shaped plastic head 126. The T-shaped head 126 comprises a coupling 128 with diametrically opposite, outwardly extending, radial lugs or pins 130 and 132 which provide keys to slidably engage the coupling-receiving slots 38 and 40 of the receptacle 17. The shaft has an enlarged diameter lower section 134 (FIG. 2) which extends above and is secured in an interference fit with the shaft-receiving hole 94 of the pedestal 92 of the platform 84. An upper collar 136 comprising a resilient plastic C-shaped retainer can be seated upon the top of the pedestal 92 to clamp the enlarged section 134 of the plastic shaft 124.

As shown in FIG. 2, the plastic shaft 124 has a lower annular circular collar 138 and a lower, downwardly extending handle 140. The lower collar 138 has an outside diameter larger than the central hole 94 of the pedestal 92 of the platform 84 to position the handle 140 below the hole 140. The lower collar 138 also serves as a bearing to accommodate smooth rotation of the handle 140. The handle 140 can comprise a manually grippable, end portion in the form of a flat or planar, rectangular blade or grippable member 142. The handle 140 is rotatably positioned in the handle-receiving opening 106 of the base 96 and extends downwardly below the upper surface 102 of the base 96 to a location above the lower surface 104 of the base 96.

In use, the handle 140 (FIG. 2) of the plastic shaft 124 is rotated about 90 degrees to move the lugs 130 and 132 of the T-shaped coupling head 126 from an access, insertion, and removal position to slidably engage the coupling-receiving slots 38 and 40 of the receptacle 17 when placing and removing the display container assembly 12 from the platform 84 in order to to access, insert, of remove the advertising material from the display container assembly 12. The handle 140 of the plastic shaft 124 can be rotated about another 90 degrees to move the lugs 130 and 132 of the T-shaped coupling head 126 to a locking position in the recessed lug-receiving opening 42 of the receptacle 17 and transverse to the coupling-receiving slots 38 and 40 of the receptacle 17 in order to securely mount and detachably connect the plastic shaft 124 in snap-fitting interlocking engagement to the display container assembly 12 .

Figure 5:
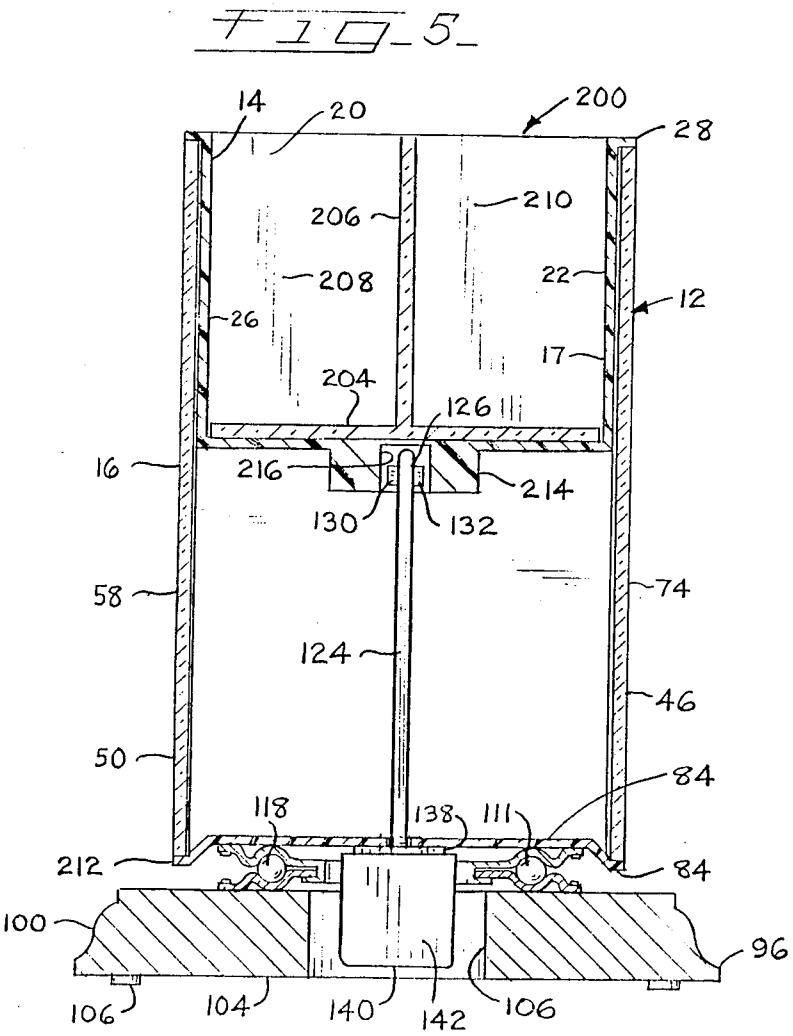
FIG. 5 is a cross-sectional side view of the advertising display apparatus of FIG. 4 with the T-shaped partition in the receptacle.
Figure 4:
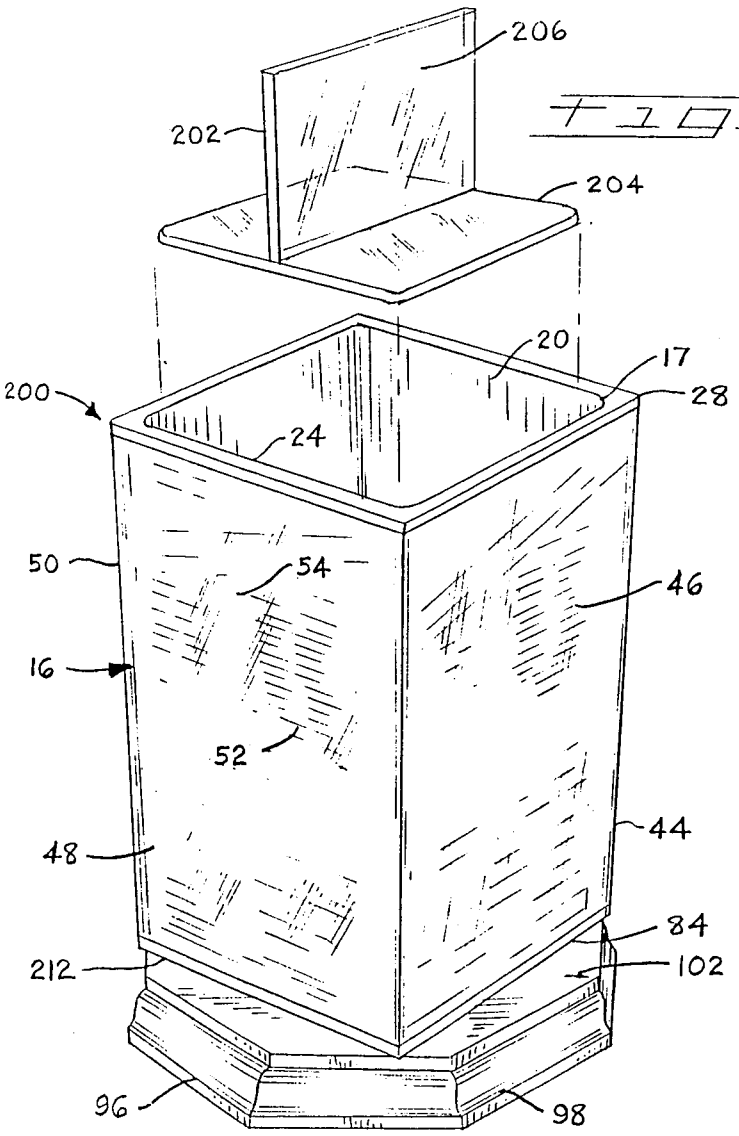
FIG. 4 is a perspective view of another advertising display apparatus with a T-shaped partition being placed in the receptacle in accordance with principles of the present invention.

The advertising display card apparatus 200 of FIGS. 4 and 5 also provides a rotatable miniature billboard assembly. Except where otherwise specifically indicated below, the advertising display apparatus 100 of FIGS. 4 and 5 are structurally and functionally similar to the advertising display apparatus 10 of FIGS. 1–3 and provide similar advantages and benefits as the advertising display apparatus 10 of FIGS. 1–3.

The advertising display apparatus 200 of FIGS. 4 and 5 has a removable, transparent, rigid plastic, T-shaped member 202 instead of a partition 78 and ribs 76 as in FIGS. 1 and 2. The T-shaped member 202 (FIGS. 4 and 5) has a flat or planar, rectangular base portion 204 which seats upon the floor of said receptacle 17 and an upright barrier wall 206 which provides a partition that extends integrally upwardly from the base portion 204 between opposite walls 20 and 24 of the receptacle 17 to divide the receptacle 17 into two separate chambers or compartments 208 and 210 to separate different items, such as packets of salt and pepper.

The lower flange portion of the platform 84 of the advertising display apparatus 200 of FIGS. 4 and 5 comprises a contiguous or continuous rectangular flange section 212. The upper hub or foot 214 (FIG. 5) which extends downwardly from the central portion of the floor of the receptacle 17 can be larger than the upper hub or foot 32 of FIG. 2. The central opening or recess shaft-receiving hole 216 is countersunk in the hub (foot) 214 so that it need not extend through the top portion of the hub 214.

The plastic shaft 124 of the advertising display apparatus 200 of FIG. 5 does not have an enlarged diameter shaft section 134 (FIG. 2) and the platform 84 (FIG. 5) does not have a pedestal 92 (FIG. 2). If desired, the advertising display apparatus 200 of FIGS. 4 and 5 can include an enlarged diameter shaft section and a pedestal, similar to FIGS. 1 and 2, for enhanced structural strength.

The advertising display apparatus provides means for displaying a plurality of advertisements, including business cards, menus and the like, with many of the cards facing in a different direction. The advertising display apparatus comprises a single integral transparent cover which protects the advertisements from fingerprints, liquids, food, and dirt. The card holding means can comprise a hollow, vertically disposed tube or transparent outer shell with a rectangular horizontal cross-section. The tube can have a top end, a bottom end, a top piece with a bottom surface, a bottom piece with a bottom surface, and a set of four walls or side pieces. The bottom piece and side pieces can form a solid integral unit. The top piece preferably is not permanently attached to the tube so that the support members which hold the cards can be easily removed from tube through the top end. Each side piece can comprise an outer surface and an inner surface. Alternatively, the top piece can be permanently attached to top end and the bottom piece can be removably attached to the bottom end. After the advertisements are placed in the tube through the bottom end, the tube can be placed over and adjacent to the bottom piece.

The tube or outer shell can be rotatably mounted to the platform and base so that the direction in which a given card or other advertisement. The tube or outer shell free rotate on the swivel assembly about the base with a minimum of friction so that each side of the window of the tube or outer shell can be easily viewed at any desired position by the customer.

An inner shell comprising a plurality of support members, or display sections can provide means for displaying numerous advertisements. Each support member can be vertically disposed contiguous to a respective inside wall of a side piece. Each support member can face a different direction when in place in the transparent outer shell or tube. Each support member has an outside surface and an inside surface. The outside surface of the support member faces the inside wall of a corresponding side piece. Three cylindrical plastic ridge members can be glued to the outside surface of each support member to form three support sections of a size adapted to permit a standard sizes business card to snap-fit between any two ridge members. The cards may be removed and replaced with other cards without removing the remaining cards. A support ridge can also be permanently glued to the top inside surface of each side piece to hold the top business card in place when a support member is in position as well as to form a ledge around the inside perimeter of the top end of the outer shell or tube to support the top piece.

An inner shell comprising a small strip-like sheet of resilient plastic can be rolled into a tube. The plastic sheet is of a size which when placed into the cavity of the transparent outer shell or tube, normally expands between an expanded, open position and a partially closed position. The expansion is due to the inherent expanding force caused by rolling it into a tube. This expanding force simultaneously pushes, or urges, in an outwardly direction, against the inside surface of each support member, thereby causing each support member to press against the advertisement and inside wall of each side piece. The support members stay in a fixed position against their corresponding side pieces until plastic sheet is removed. While the length of the tube need only be long enough to permit a reasonable expansion inside of tube, the height preferably is at least tall enough to press against the top third of the top support section of each support member to ensure that each support member is substantially contiguous against the inside wall. Such an arrangement permits the removal of each support member as quickly as possible while preventing the support members from falling backward into the cavity of the tube. Slots can also be used on the inner walls of each side piece to permit the insertion and removal of each support member.

A plurality of support members, or panels, can be each hingedly connected to at least one other panel, there being a panel for each wall on the tube and each panel faces in a different respective direction. The panels can also comprise means for displaying numerous advertisements. Each panel can be vertically disposed contiguous to a corresponding inside wall of a side piece. Each panel can face a different respective direction when in place in tube. The outside surface of the panel faces the inside wall of a corresponding side piece.

Each panel includes a mounting portion for mounting at least one advertisement and comprises a plurality of display section. The display sections can be formed by a plurality of ridges which comprise means for displaying an advertisement. A standard sized business card can fit between any two ridges. The cards may be removed and replaced with other cards without removing the remaining cards. The cards can be removably mounted to each section, such as with artist's glue.

The support members or panels can be incorporated and integrated into the inner shell comprising a strip-like means or member for urging the advertisement on each support member toward its respective wall on the tube. The sheet of resiliently deformable plastic is deformable between an open position and a second position in which the strip is at least partially closed, when it is placed inside the tube cavity of the outer shell. The strip-like member can comprise at least one inside panel and a pair of end panels. Each end panel can have an unconnected outer edge and an inner edge connected to an inside panel. The end panels can be joined to the inside panels along their edges. The inside panels can be joined at their edges. The expansion of the strip when it is within the tube is due to the inherent expanding force in the panels when the edges are made by bending a straight strip at the edges. This expanding force simultaneously pushes, or urges each panel, in an outwardly direction against the inside surface of each wall. When the panels are mounted in the tube, they stay in a fixed position against their corresponding side walls until they are removed through the bottom end of the tube for movement relative to the base to change the direction in which a given advertisement faces, and they conform substantially to the shape of the tube when it is in the partially closed second position. The outer edge of the end panels are substantially adjacent to each other when the strip-like member is in its partially closed position.

If desired, cardboard may be used in place of the plastic support members comprising the inner shell. However, in such a case, each advertisement should be permanently glued to the cardboard. If an advertiser wishes to use two or more support sections this can be accomplished by deleting one more support ridges from a support member.

The outer shell or tube can be constructed out of a transparent plastic, such as polypropylene, polyethylene, mylar, or lucite. It may be assembled by gluing the individual pieces together, or it may be molded into a one piece integral base and a one piece tube.

The advertising display apparatus can hold numerous advertisements at one time. A multiple tier tube, such as a four tier tube or a two tier tube can be used. Individual business cards can be used as the advertising material. One may use, however, other suitable advertising means, such as a single card or sheet of paper of a size to fit onto the entire area of one side of the support member (each wall section of the inner shell). Each support member can comprises three to four display sections. Each display section holds one advertisement, business card, or sheet of paper with advertising indicia thereon. The display apparatus is capable of simultaneously displaying numerous advertisements, such as 12 to 16 business cards. Any number of cards is theoretically possible to use with each support member; however, it is preferred to use no less than two cards, and no more than four cards for each support member. Furthermore, a single card, advertisement, or menu could be attached to a support member. The advertising display apparatus of the subject invention may also be used with a base condiment holder.

Among the many advantages of the advertising display apparatus are that it is:

1. Aesthetically pleasing.
2. Attractive.
3. Appealing.
4. Lightweight.
5. Compact.
6. Economical.
7. Interchangeable.
8. Flexible.
9. Easy to use.
10. Simple to manufacture and assemble.
11. Portable.
12. Reusable.
13. Producible in different sizes with various pockets or windows to accommodate different size advertisements and customer preferences.
14. Convenient.
15. Effective.

Although embodiments of the invention have been shown and described, it is to be understood that various modifications and substitutions, as well as rearrangements of parts, can be made by those skilled in the art without departing from the novel spirit and scope of this invention.

What is claimed is:

1. A miniature billboard assembly, comprising:

a display container comprising a receptacle for holding items such as packets of salt, pepper, sugar, and toothpicks, said receptacle defining a central opening comprising shaft-receiving opening and a coupling-receiving slot extending transversely outwardly of said shaft-receiving opening and having means for displaying at least one advertisement;

a base for supporting said container, said base have a top surface and a bottom surface;

an upright impact-resistant plastic shaft extending upwardly through said base, said shaft having a head comprising a coupling at one end positioned above said top surface of said base and a handle at the other end positioned below said top surface of said base for moving said coupling from an access position for slidably engaging said coupling-receiving opening when inserting and removing said container from said shaft to a locking position upwardly of and transverse to said coupling-receiving slot for interlocking engaging and securely mounting said container to said shaft upon said base.

2. A miniature billboard assembly in accordance with claim 1 including bearing means operatively connected to said shaft for rotating said container on said base.

3. A miniature billboard assembly in accordance with claim 1 wherein said handle comprises a manually grippable end portion extending transversely outwardly of said shaft.

4. A miniature billboard assembly in accordance with claim 3 wherein said manually grippable end portion comprises a generally planar blade.

5. A miniature billboard assembly in accordance with claim 1 wherein said coupling comprises at least one radial lug.

6. A miniature billboard assembly in accordance with claim 1 wherein said coupling comprises a transverse plastic pin.

7. A miniature billboard assembly in accordance with claim 1 wherein said head comprises a generally T-shaped coupling.

8. A miniature billboard assembly in accordance with claim 1 wherein said means comprises at least one transparent plastic window.

9. A miniature billboard assembly, comprising:

a display container comprising a substantially translucent plastic core and a substantially transparent plastic outer shell, said core comprising an open top receptacle for holding items such as packets of salt, pepper, sugar and toothpicks, said receptacle being substantially rigid and having a substantially horizontal floor and substantially vertical rectangular walls extending upwardly from said floor, said receptacle having a substantially rectangular, flange connected to and extending outwardly of an upper portion of said walls, said flange defining an access opening at the upper portion of said receptacle for accessing said items in said receptacle, said outer shell comprising a substantially rectangular rigid tube with rectangular wall portions providing windows for viewing advertising material including some material selected from the group consisting of a business card and a sheet of paper having advertising indicia thereon, said wall portions of said outer shell having an inner surface, a flexible plastic, opaque inner shell positioned adjacent said inner surface of said outer shell, said inner shell comprising substantially rectangular tubular wall sections having an outer surface, said outer surface of said inner shell substantially covering said inner surface of said outer shell, said advertising material being sandwiched and positioned between said outer surface of said inner shell and said inner surface of said outer shell, said shells abutting against and engaging said upper flange of said receptacle and positioned adjacent said wall of said receptacle, said shells extending substantially downwardly from said flange and said floor of said receptacle to provide a downwardly extending, substantially rectangular, composite skirt, said skirt having a bottom edge, and said floor of said receptacle having a central portion defining a central opening comprising a shaft-receiving opening, diametrically opposite coupling-receiving slots providing keyways extending transversely outwardly of said shaft-receiving opening, and a lug-receiving recessed opening having a greater diameter than and being positioned above said shaft-receiving opening;

a substantially rectangular plastic platform having a peripheral flange portion for abuttingly engaging and supporting the bottom edge of said shells, said platform having an underside and a central section defining a central shaft-receiving hole;

a wooden base having a substantially planar lower surface for positioning upon a table or counter in a restaurant, said base defining a central handle-receiving opening;

a swivel assembly for permitting said display container and platform to rotate upon said base, said swivel assembly defining a central shaft-receiving hole and comprising an annular ball bearing assembly, said annular ball bearing assembly having lower metal plate secured to said upper surface of said base and an upper metal plate secured to the underside of said platform; and an upright semi-rigid shaft of impact-resistant plastic for slidably engaging said shaft-receiving opening of said receptacle, said shaft having an upper substantially T-shaped head comprising a coupling with diametrically opposite, outwardly extending lugs providing keys for slidably engaging said coupling-receiving slots of said receptacle, and said shaft having a lower downwardly extending handle comprising a manually grippable, substantially rectangular, planar blade rotatably positioned in said handle-receiving opening of said base, said handle extending downwardly below said upper surface of said base to a location above said lower surface of said base, said handle being rotatably to move said lugs from an access position slidably engaging said coupling-receiving slots of said receptacle when placing and removing said display container from said platform to access, insert, of remove said advertising material from said display container, to a locking position substantially transverse to said slots in said recessed lug-receiving opening of said receptacle for detachably securing said display case to said shaft in snap-fitting interlocking engagement.

10. A miniature billboard assembly in accordance with claim 9 wherein said display container includes a removable T-shaped member having a substantially planar rectangular base portion for positioning upon the floor of said receptacle and an upright barrier wall extending upwardly from said substantially planar rectangular base portion between opposite walls of said receptacle for separating packets of salt from packets of pepper in said receptacle.

11. A miniature billboard assembly in accordance with claim 9 including a pair of ribs extending inwardly from opposite walls of said receptacle and an upright, generally planar, rectangular plastic partition in snap-fitting interlocking engagement with said ribs.

12. A miniature billboard assembly in accordance with claim 9 wherein said central portion of said floor of said receptacle includes a downwardly extending hub.

13. A miniature billboard assembly in accordance with claim 9 wherein said flange portion of said platform comprises perpendicular L-shaped corner sections.

14. A miniature billboard assembly in accordance with claim 9 wherein said flange portion of said platform comprises a contiguous rectangular flange section.

15. A miniature billboard assembly in accordance with claim 9 wherein said wooden base comprises a substantially octagonal base.

16. A miniature billboard assembly in accordance with claim 9 wherein said shaft includes a lower collar having a diameter greater than said hole in said platform and said lower collar provides a bearing surface for slidably engaging the underside of said platform.

17. A miniature billboard assembly in accordance with claim 16 wherein said central section of said platform has an upwardly extending pedestal.

18. A miniature billboard assembly in accordance with claim 17 wherein said shaft has an enlarged section in interference fit with said pedestal.

19. A miniature billboard assembly in accordance with claim 18 including an upper collar comprising a resilient C-shaped retainer for clamping said enlarged section of shaft upon said pedestal.

* * * * *